United States Patent [19]

Bernardi et al.

[11] 3,976,291

[45] Aug. 24, 1976

[54] ARRANGEMENT FOR SEPARATING SHEETS OF PAPER AND THE LIKE

[75] Inventors: Herbert Bernardi; Erhard Lehle; Joseph Geier, all of Munich; Gerd Von Aschwege, Grobenzell; Markus Haberstroh, Munich, all of Germany

[73] Assignee: G.A.O. Gesellschaft fur Automation und Organisation m.b.H., Germany

[22] Filed: Nov. 18, 1974

[21] Appl. No.: 524,866

[30] Foreign Application Priority Data

Nov. 21, 1973 Austria ..... 9780/73

[52] U.S. Cl. ..... 271/94; 271/12; 271/30 A; 271/37; 271/104; 271/122; 271/146; 271/149

[51] Int. Cl.[2] ..... B65H 3/10; B65H 3/52; B65H 1/02

[58] Field of Search ..... 271/94, 96, 104, 122, 271/30 R, 30 A, 11, 12, 13, 146, 149, 37, 95, 99

[56] References Cited

UNITED STATES PATENTS

| | | | |
|---|---|---|---|
| 3,025,052 | 3/1962 | Gutteling | 271/94 |
| 3,126,199 | 3/1964 | Rosoff | 271/94 X |
| 3,173,684 | 3/1965 | Binzoni et al. | 271/122 X |
| 3,235,249 | 2/1966 | Street et al. | 271/104 X |
| 3,240,489 | 3/1966 | Pinckney et al. | 271/146 |
| 3,291,482 | 12/1966 | Stemmler | 271/94 X |

*Primary Examiner*—John J. Love
*Assistant Examiner*—Bruce H. Stoner, Jr.
*Attorney, Agent, or Firm*—McGlew and Tuttle

[57] ABSTRACT

In the arrangement, a batch or stack of vertically oriented recording media sheets is supported on edge on a horizontal vibrating table which is vibrated by a vibrating conveyor and the sheets are advanced singly, starting with the leading or frontmost sheet, through a separating slot between a pair of endless belts constituting a transporting arrangement. A first rotating suction drum is mounted at the rear end of the vibrating table and is formed with circumferentially spaced suction bores for operative relation with a rotary slide valve to connect the suction bores intermittently to a suction system. A second rotating suction drum is arranged within the range of the separating slot and serves as a separating drum, and a hold-back suction drum is also arranged within the range of the separating slot and serves as a hold-back device, the hold-back suction drum having the same design as the first rotating suction drum. The second rotating suction drum is also operatively associated with a rotary slide valve and has a single series of slots aligned in an axial plane and intermittently connected to a suction system by the associated rotary slide valve.

15 Claims, 7 Drawing Figures

ARRANGEMENT FOR SEPARATING SHEETS OF PAPER AND THE LIKE

FIELD AND BACKGROUND OF THE INVENTION

The present invention relates to an arrangement for separating or singling out paper sheets, documents, and similar recording media from a batch, with initially several of the sheets or documents, etc. being moved toward a separating slot with the aid of an intermittent pull-off device and a vibrating device, whereupon the leading recording medium, with the aid of a further pull-off device and an intermittently acting device serving to hold back the trailing recording media, is pulled from the moved batch and fed to the transporting arrangement.

Basically, there exists the danger, in such types of separating devices, that simultaneously two sheets are pulled off, this being due to the fact that the two sheets adhere to one another e.g. on account of electrostatic charges or molecular adhesion. For avoiding such double pull-offs there have already been proposed a great number of solutions. According to one such known principle of solution, the sheets or cards, as pulled from the batch, are pushed through a slot whose opening corresponds to the thickness of the sheets or cards. This arrangement, however, has the disadvantage that only sheets or cards of always the same thickness can be separated which, in addition thereto, must also be unused, because experience has shown that frequently used documents and cards are thicker than new ones because of being folded, creased and soiled during usage. After a more or less long period of circulation, the documents as regards their condition and the paper qualities, will partly differ from one another to such an extent that a mechanical sorting will already appear to be frustrated e.g. by the separating or singling-out problem.

Therefore, it has been suggested by another proposal (German Pat. No. 1,185,628) to guide the document, as pulled from the batch, between two oppositely driven feed rollers so that any eventual second document, also pulled from the batch, will be held back or returned. It is considered one disadvantage of this proposal that the hold-back roller will grind on the extracted document in cases where no second document has also been extracted, so that the forward movement of the document is retarded, thus causing the separating process as a whole to be slowed down.

Another conventional method of making the separation of documents more reliable resides in letting the pull-off or extracted rollers act intermittently upon the batch, which may be effected, for example, with the aid of a cam plate or an eccentric friction wheel (German Pat. No. 1,611,382). In cooperation with a hold-back roller it is already possible in this case to expect a considerable reliability with respect to an individual pull-off, but the German Published Application Pat. (DOS) No. 2,209,483 shows that a separating device of this kind involves a rather considerable investment.

As pull-off rollers, it is possible to use friction wheels or suction drums, with the suction drums having the advantage of more reliably seizing used documents. U.S. Pat. No. 3,300,207 discloses, for example, a vacuum-controlled security document separating device. By this patent it is proposed to use a separating device in which three rectangular sheetmetal members, which are provided with louvers, are displaced with respect to one another, thus closing or releasing the opening of a vacuum chamber. By the to and fro movement of the sheetmetal members the respective document (note) lying closest to the outer sheetmetal member is sucked on and fed to a transporting system. Driving is effected by a motor which, via an eccentric disc, actuates a somewhat expensive lever mechanism. Any second documents also extracted are held back by a vacuum chamber which, with respect to the document batch, is arranged to be staggered in relation to the separating (singling-out) sheetmetal members.

The particular disadvantages of this arrangement are seen in the fact of involving a considerable investment in mechanical means, in which case the compensation of the moving masses is deemed to cause just as many difficulties during manufacture as the prevention of pilot or leakage air between the sheetmetal slides and the vacuum chamber. Of course, the upper limit frequency of ten documents per second is considered to be very good, but finds its restriction in the sequence of movements of the conveying sheetmetal members which have to be accelerated twice and stopped again during each separating process. For the reasons outlines above, this system does not seem to be particularly suitable for being improved. Moreover, the system offers only a small protection against multiple pull-off or extracting operations when considering that, only in the case of double pull-offs, can the second document be held back. In cases where e.g. three documents are moved towards the transporting system, the third document is sucked on while the second one remains unaffected by the hold-back device. Apart from this, the sucking force effecting the holding back must be overcome by the sucking force effecting the separation (singling-out).

SUMMARY OF THE INVENTION

In starting out from an arrangement of the type described hereinbefore, it is proposed by the invention to provide, as an intermittent pull-off device, a rotating suction drum arranged at the rear end of the batch considered in the direction of movement, with the suction bores in the drum being intermittently connected to the suction system via a rotary slide valve, to provide, as the vibrating device, a vibrating (shaking) table on which the documents of the batch rest on edge and, moreover, to provide, within the area of the separating slot, a rotating suction drum for acting as the separating drum and the hold-back suction drum serving as the hold-back device and designed similarly to, or identically with, the first-mentioned suction drum.

The invention is based on the recognition as known per se, that double or multiple pull-off or extraction operations are possible if, together with the leading document, one or more further documents are sucked on by the separating drum or, in cases where loose documents, owing to the static friction effect, are pushed as well through the separating slot, in which case static friction may still be increased by soiling or adhesives.

The invention features a number of important advantages. Thus, by the special arrangement and design of the suction drums there is safeguarded a reliable separation each time of only one document. This is effected independently of the thickness of the paper also in the case of documents prepared by using adhesives, or provided with dog's ears (creases). Considering that the hold-back drum rotates in opposition to the direction of rotation of the separating device, and continuously pushes back all documents which are not to be separated, it is impossible for the separating reliability to be impaired by the appearance of several documents in the separating gap. Moreover, the force, by which the hold-back drum pushes back the excessive documents, can be chosen at will without thus impairing the separating function, because the force of the hold-back drum will act upon the document only as long as necessary for pushing it back into the batch. Likewise, the sucking force of the separating drum is not required to act in opposition to the sucking force of the hold-back drum. Moreover, the mechanical construction is relatively simple and, owing to the rotary-slide-valve-controlled suction drums, completely unproblematic with respect to pilot or leakage air. The speed at which the documents can be separated is extensively determined by both the paper quality and the employed intake (suction) air, but not by the mechanical arrangement of the system, because rotary movements are used exclusively. Accordingly, it is possible to adapt the system to the respective requirements without having to change the separating device itself.

For an understanding of the principles of the invention, reference is made to the following description of typical embodiments thereof as illustrated in the accompanying drawings.

DESCRIPTION OF THE PREFERRED EMBODIMENTS

Figure 1:
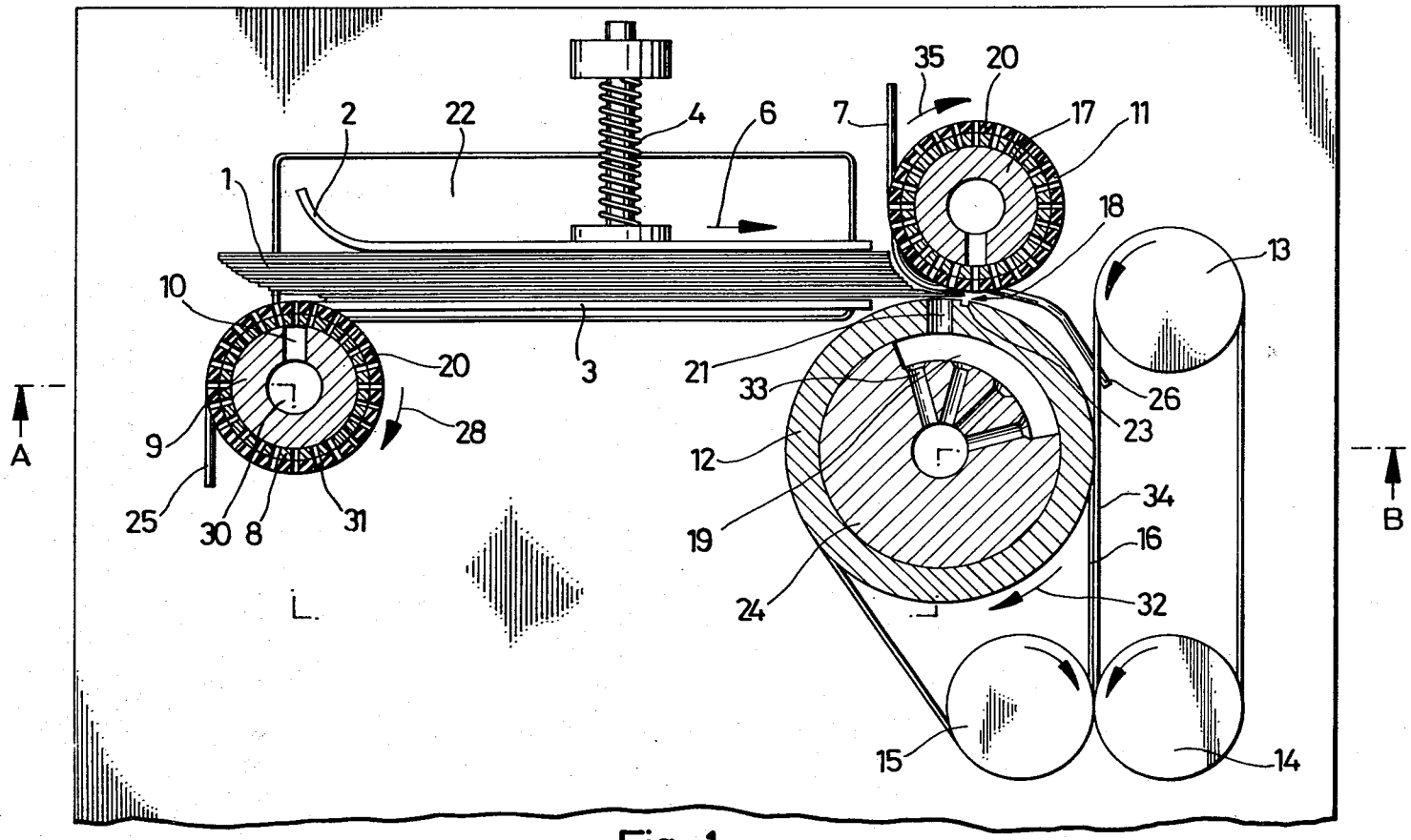
FIG. 1 is a somewhat schematic horizontal sectional view of a separating device embodying the invention.

FIG. 1 schematically shows one embodiment of the novel separating device, with all parts not necessarily contributing towards a better understanding of the invention having been omitted. The batch 1, consisting of upright documents, or the like stacked on edge, is pressed in such a way by the spring 4 via the pressure plate 2 upon the supporting plate 3 that the documents are retained in their batch form and prevented from tilting.

The batch 1 is positioned with its sheets stacked on edge on a vibrating device comprising a support table 22 and a vibrator consisting of the electromagnet 5 and the armature 27 (FIG. 2), to which the baseplate 22 is firmly attached. As may be recognized from FIG. 1, the batch 1 is shaken by this arrangement in the direction as indicated by the arrow 6, with the rear documents engaging the hold-back rake 7.

On the left of the batch 1 (in FIG. 1) there is shown to be arranged the feed drum 8 which is designed as a suction drum rotating in the direction as indicated by the arrow 28. The feed drum 8, just like the hold-back drum 11, is coated with a material 20 (such as Vullkolan) having a high coefficient of friction with respect to the paper. Inside the suction drum 8 there is positioned the stationary concentric roller 9 acting as a rotary slide valve because of comprising one channel 10 establishing a connection to the (not shown) evacuating system via the hollow axle 30. Considering that the suction drum comprises a nu;mber of channels 31 equally distributed along its circumference, while the rotary slide valve 9 comprises only one channel 10, there is caused an intermittent sucking-on of the leading or frontmost document in the batch 1. In this way, together with the vibrating device, there is effected the rhythmical transportation of the leading document in the direction as indicated by the arrow 6. The rotary slide valve 9 is adjusted to the format length of the documents and may be readjusted together with the suction drum 8, thus resulting in an exact positioning of the documents.

The two-dimensional shaking or vibration as caused by both the baseplate 22 and the suction drum 8 will effect a reliable separation of documents (notes) slightly adhering to one another.

The directed shaking or vibrating movement is laid out so as to effect the slow movement of the documents in a direction towards the separating drum 12, in front of which they are finally positioned. Within the range of the front documents, this movement is still assisted by the suction drum 8.

Documents really stuck firmly to one another cannot and are not to be separated, because otherwise it cannot be safeguarded that none of the documentns is damaged. A sorting out of these double documents which, under certain circumstances, may be avoided by a short preliminary inspection of the batch prior to being inserted into the separating device, must be carried out, if so required, by means of a thickness gauge.

As is evident from FIG. 1, the documents abut the hold-back rake 7. This rake effects a parting from the hold-back drum 11 and assures that always only the leading or foremost documents are moved towards the separating slot 18. The separating drum 12 rotates in the direction as indicated by the arrow 32 on the stationary, concentric rotary slide valve 24. This rotary slide valve 24 comprises several channels 33 within the range of opening 19, via which it is in connection with a (not shown) vacuum pump. In distinction thereto, the separating drum 12 comprises only one single row of suction holes 21 in an axial plane. The rotary slide valve opening 19 permits passage of the suction or intake air for such a period of time, and is so adjusted, that the leading document, within the range of its front edge, will be reliably sucked-on and pulled into the transporting system comprising the belts 16 and 34 and the drive (feed) rollers 13, 14 and 15. The angular extent of aperture 19 of the rotary slide valve opening amounts to about 100°. This angle of aperture of the rotary slide valve opening, however, may also be changed at will depending on requirements.

Figure 2:
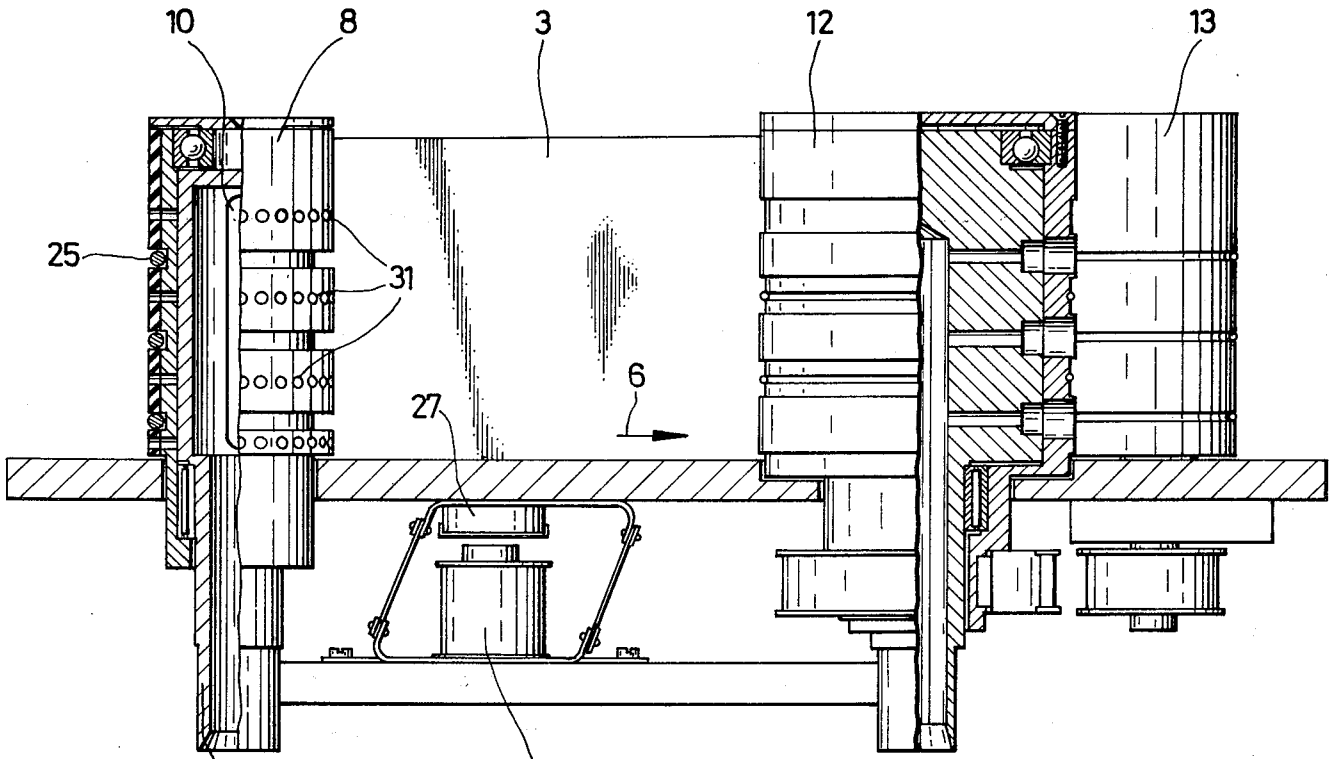
FIG. 2 is a vertical sectional view taken along the line A–B of FIG. 1.

For the sake of enabling a better understanding, the rotary slide valve 24 as comprising one channel 33, and the separating drum 12 as comprising the suction holes 21, have been turned in FIG. 2 into the plane of the section A–B.

For preventing two or more of the documents as transported to the hold-back rake 7, from being pulled off, there has been provided the hold-back device consisting of the hold-back drum 11 and of the rotary slide valve 17. This hold-back device 11, 17 is designed in exactly the same way as the forward transporting (feed) device 8, 9. The hold-back drum 11 rotates in a sense opposite to that of the separating drum 12, i.e. in the direction as indicated by the arrow 35. In this way all documents which are to be separated (singled-out), with the exception of the leading or frontmost one, are transported in opposition to the direction as indicated by the arrow 6, and returned into the batch. This return movement of the rear documents is also effected intermittently, as may be recognized from FIG. 1.

Accordingly, the leading or frontmost document is further transported by the separating drum 12 and seized by the transporting (feed) belts 16 and 34 as driven by the feed rollers 13, 14 and 15. The cooperation of both the separating and the hold-back drum permits using a separating (singling-out) gap or slot having a width of about 3 mm. Accordingly, stuck documents are permitted to pass through this gap without putting the separating device out of operation. The same, of course, also applies to such documents which have been repaired with the aid of adhesive tape and which, at these points of repair, exceed the usual thickness.

Owing to the intermittent forward transport and the shaking or vibrating movement of the batch of documents, always several documents are simultaneously brought to the hold-back rake 7, in the course of which it might also become possible for one of these documents to come to lie with its front edge ahead of the front edge of the leading or frontmost document. Thus, this particular document, owing to the pilot or leakage air, might be sucked on as well during the sucking-on of the leading document by means of the suction drum 12. In order to avoid this, air vent slots (louvers) are provided circumferentially adjacent the suction bores 21, for effecting that the pilot or leakage air will no longer enter via the front edges of the documents, but just at the bores 21, thus preventing a second document from being sucked-on as well.

If the separating drum 12 were provided only with suction bores 21, without a vent slot, after a sheet becomes attached thereto by suction, an underpressure zone builds up in the area around suction bores 21, and this causes the sheets to adhere to the separating drum not only in the area of the bores 21 but, in addition, in a surface area which is much larger. This is due to the fact that the rough paper surface does not provide for satisfactory sealing of suction bores 21, so that additional air is aspirated from the ambient air. The underpressure zone, built up in this manner, is limited by the respective edges of the sheet, namely the leading edge, the top edge and the bottom edge, as well as by the peel-off line at which the sheet is mechanically bent off the drum because of the supporting action of the front edge of the supporting plate 3.

If now, prior to, or during attachment of a sheet by suction to drum 12 to be normally singled out, a second sheet is shifted forward so that its leading edge extends beyond the leading edge of the first sheet, the second sheet comes within the range of the leading intake or ambient air stream and thus applies, while sealing the leakage of the leading edge of the first sheet, firmly against the drum along with the first sheet.

Figure 3:
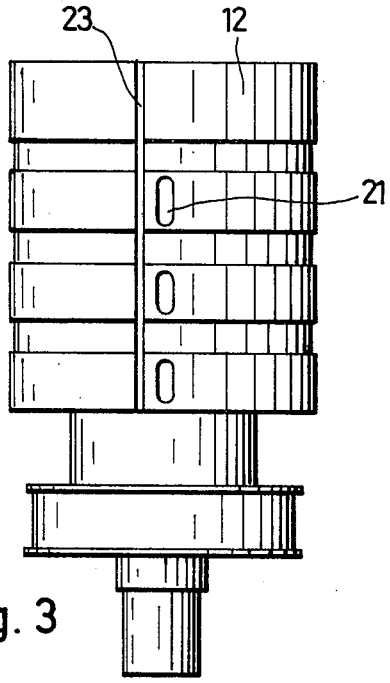
FIGS. 3 and 4 are elevation views of two different embodiments of a separating drum.
Figure 4:
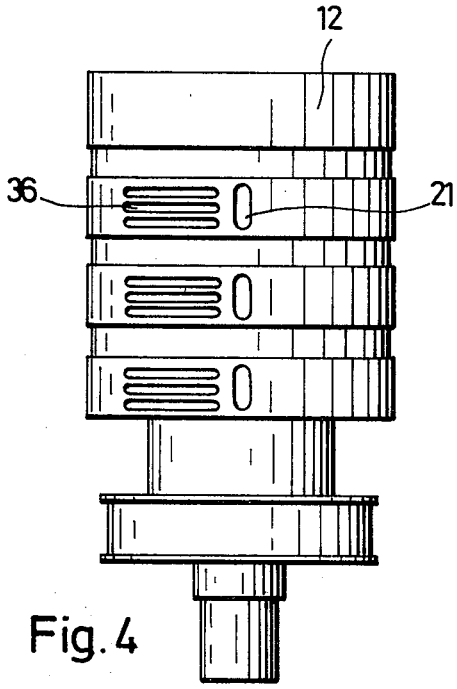

The vent slots are a remedy for this situation since, due to this intentional deformation of the drum surface by the formation of the vent slots therein as shown in FIGS. 3 and 4, the underpressure zone at the leading edge of the first sheet is broken down to an extent such that an overlapping second sheet can no longer seal this leakage. This may be done by providing either a vertical slot 23 which, being positioned beneath the sheet edges, takes the "leading-edge leakage air" in laterally, that is, from the top and bottom ends of the slot, or by providing horizontal slots 36 which are located so that they cannot be completely covered by a second sheet. Thus, the slot 23 prevents any suction stream causing the leading edge of the first sheet to adhere, while slots 36 provide for particular favorable conditions for the "leading-edge suction stream" which cannot be affected by the overlapping of the second sheet. In both cases, the attachment by suction of the second sheet is prevented.

From FIG. 3 it may be recognized that one single air vent slot (louver) 23 may be provided extending parallel to the axis of rotation of the suction drum 12. Instead of the parallel air vent slot 23, it is also, possible to provide air vent slots 36 extending perpendicularly in relation thereto (FIG. 4).

For preventing a document from being moved or deformed in an unwanted manner by either the suction drum 8, the holdback drum 11 or the feed roller 13 for reasons unforeseeable, the end of the supporting plate 3 is designed on its left-hand side as a hold-back rake 25, and the hold-back rake 7 is so designed at its end 26 as to engage the transporting system. Appropriately, the hold-back rakes 7, 26 and 25 are made from a round material for keeping adhesion forces, which might develop on the rakes owing to the pilot or leakage air, as small as possible.

Figure 5:
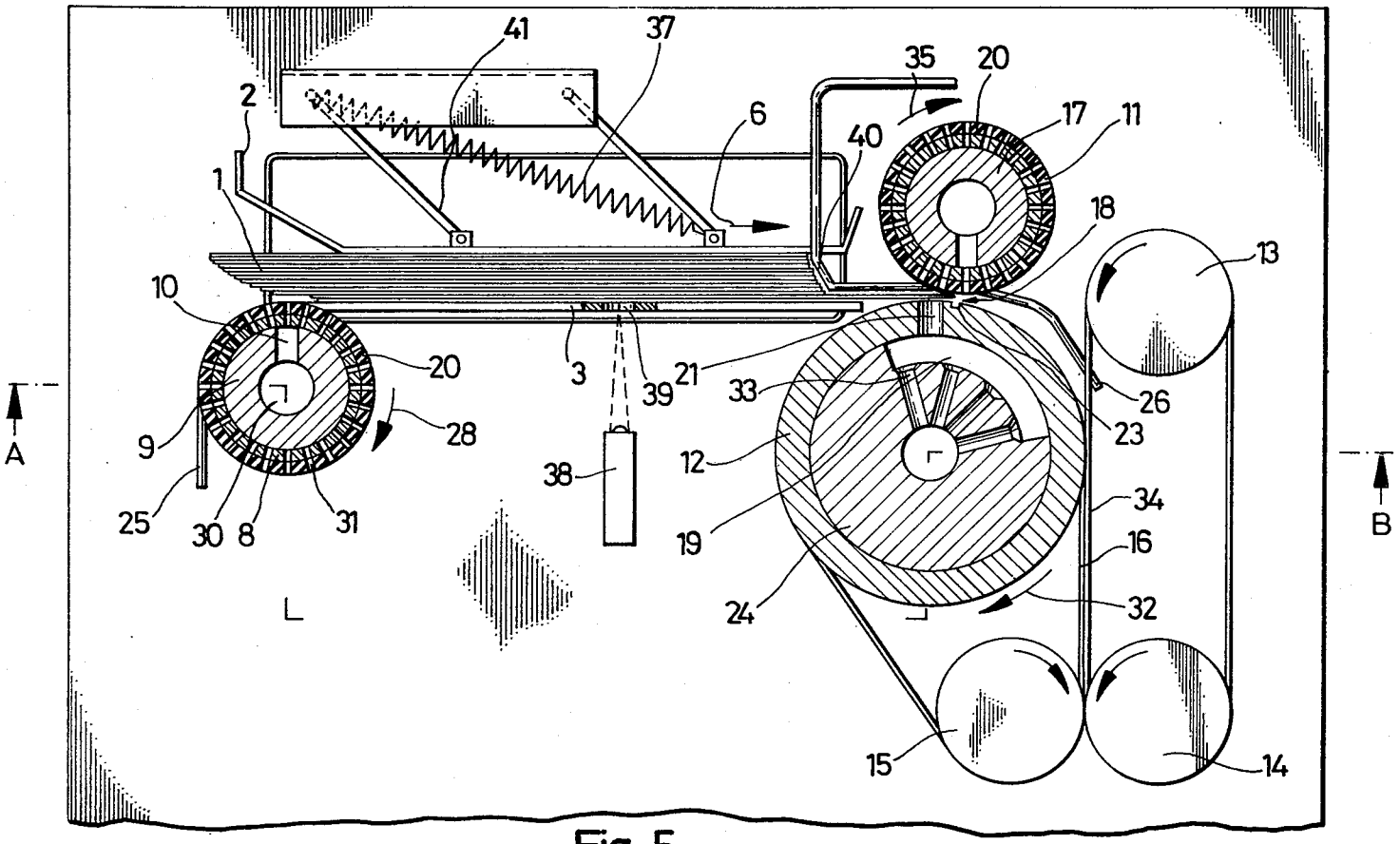
FIG. 5 is a view, similar to FIG. 1, illustrating another embodiment of the invention.

FIG. 5 shows a modified embodiment. As will be recognized, the hold-back rake within the range of the front edge of the batch, unlike in the example of FIG. 1, is arranged at a certain distance from the hold-back drum 11, so that there will result a relatively long separating gap in which the documents, especially within the range of their front edges, are fed to both the separating drum 12 and the hold-back drum 11 by being laterally supported. As will be further seen, the round bars of the hold-back rake 7 are bent off and flattened at the pint 40 so that a sharp edge will result. By this slope, which is restricted by a sharp edge, it will be achieved that always only a limited number of piled documents, e.g. 10 pieces, will be pushed into the separating gap 18. Moreover, a wedging effect will also not appear even in the case of very flabby documents.

As is further shown in FIG. 5, the pressure plate 2, which is designed as a grate, engages in the hold-back rake 7, so that, together with the extended separation gap 18, there is safeguard an uninterrupted parallel guidance of the documents.

Moreover, the pressure plate 2 is pressed against the batch 1 via the parallelogram 41 as diagonally tensioned by the tension spring 37, by which there is effected a more uniform and increased pressing-on.

Figure 6:
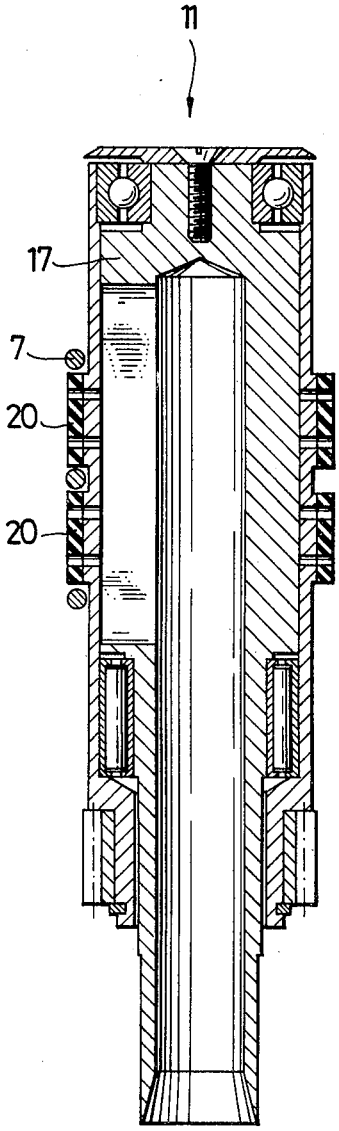
FIG. 6 is an axial sectional view through the holdback drum of the embodiment of the invention shown in FIG. 5.

FIG. 6 shows a design of the hold-back drum 11 which is modified with respect to the design of the feed or suction drum 8 and hold-back drum 11 as shown in FIG. 2. According to this modified design, the drum contains only so many rows of suction holes, that only the center part of the documents will be seized thereby. This modification provides certain advantages.

If, to the hold-back drum 11, there is applied a document or voucher which is to be pushed back, and whose front edge is bent towards the hold-back drum, it may happen that the front edge of the paper is folded by the hold-back drum, thus causing the document or voucher to be pulled back with its front edge ahead in the direction which is in opposition to the direction of separation, or is rolled up in the separating gap, because in that case it is no longer being acted upon by force and counterforce, but by a moment of force. These kinds of interferences are caused especially by dog-eared corners of the paper being turned down in the direction of the hold-back drum.

By the hold-back drum according to FIG. 6, the area of the dog-eared corners is no longer seized by the hold-back arrangement, so that, especially in connection with the long separating gap, the susceptibility to interferences is reduced almost to zero.

The modifications shown in FIGS. 5 and 6 safeguard a still more reliable separation, i.e. also of very strongly used, flabby documents or vouchers.

FIG. 5, moreover, shows, on the rear side of the supporting plate 3, the reflection light barrier 38 which, through the hole 39 in the supporting plate 3, performs a check with respect to the presence of documents. After the last document of the batch has been singled out, the refined surface of the pressure plate 2, or a mirror attached thereto, will deflect the light beam of the reflection light barrier, thus causing the suction air of the feed and separating drum to be turned off. The separating or singling out operation has to be re-started by pressing a button after a new batch of documents has been inserted.

Advantages of this arrangement are to be seen in that the suction noises and the pilot or leakage air losses are reduced to the actual operating times and, consequently, to a minimum, that the insertion of a new batch is not affected by the suction of the feed (suction) drum 9, and that the commencement of the separating or singling-out operation can be exactly controlled.

For achieving particularly high operating speeds it is possible for the separating durm 12 to be driven via a known start-stop or change-speed gear.

At a given suction, the reliable sucking-on of the document will take a minimum time of e.g. one hundredth of a second. If, moreover, for the sucking on there is available a suction angle of about 40°, there will result from this an approximate maximum separating or singling-out speed of 10 documents per second. Enlarging the suction capacity would also lead to only a very slight increase of this speed.

When stopping the separating drum 12 within the sucking-on area, or when reducing the speed thereof very considerably, for highly accelerating it after the sucking-on of the document has been effected, it is possible to very substantially increase the sucking-on time by requiring the same time of revolution per rotation, so that the separating speed can be increased to the same extent by meeting the given requirements. Thus, at a speed ratio of 1:4, for example, solely by simulating the "slow sucking-on conditions", it is possible to achieve an almost fourfold increase of the separating speed. To this end, of course, there is required an almost sinusoidal course of acceleration of the separating drum, as otherwise the document would be torn off the separating drum owing to abrupt accelerations. Moreover, both the driving and the supporting of the belts 16, 34 must be modified in such a way as to perform a constant movement independently of the start-stop operation of the separating drum. This may be carried out, for example, by supporting the belt 16 on the separating drum independently of the rotary motion of the separating drum, in which case the roller 15 would have to be driven along with one of the rollers 13, 14, by the actual feed (transporting) system.

Considering that the document is to be transferred to the belt system following a 90° rotation at the time position of the highest angular speed of the separating drum $\omega_{Amax}$, which also corresponds to the transporting speed, the gear must moreover perform two sinusoidal passages per rotation of the separating drum. Considering now that the suction holes 21, following an angle of rotation of 0° and 180°, move at the minimum speed and, following an angle of rotation of 90° and 270°, at the maximum speed, there is finally presented a separating drum with two oppositely arranged rows of suction holes with the aid of which, per drum rotation, two documents can be singled out or separated. However, quite depending on the length of the document to be processed, and the desired cycle rhythm, it may also become necessary under certain circumstances to have to adapt the diameter of the separating drum accordingly.

Figure 7:
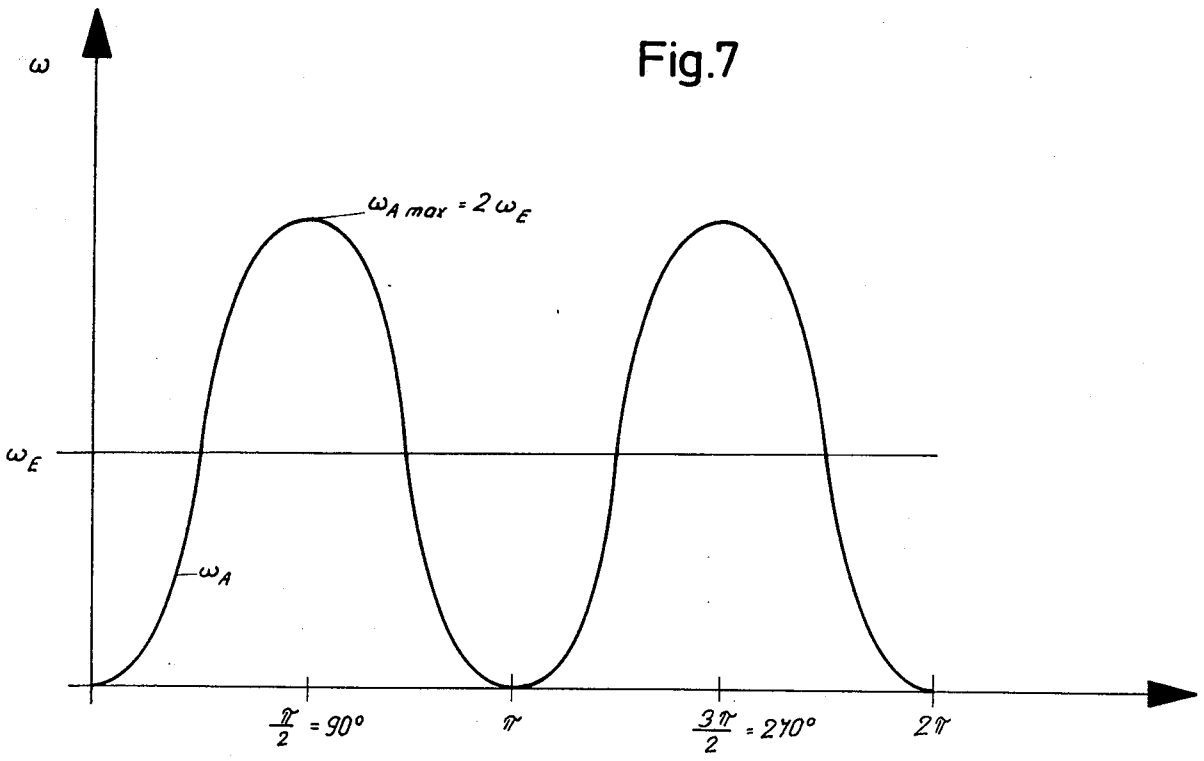
FIG. 7 is a graphic illustration of the angular speed conditions in the case of a start-stop-driven separating drum.

FIG. 7 shows the angular speed conditions in the case of a start-stop-driven separating drum, in which $\omega_E$ indicates the input angular speed, and $\omega_A$ the output angular speed of the gear. Since the output angular speed of the gear corresponds to the angular speed of the separating drum, it may be taken from this diagram that, after having performed the sinusoidal passage twice per drum rotation at $\pi/2 = 90°$, there is reached the first maximum angular speed while the second maximum is reached at $3\pi/2 = 270°$. At an angle of 0° and $2\pi = 180°$, the drum is shown to rotate at minimum speed, with this speed, of course, unlike as shown in the diagram, not necessarily having to equal 0. In addition thereto, the course of the characteristic, as already mentioned hereinbefore, may deviate from the ideal sinusoidal course in such a way that the maximum to minimum angular speed ratio will not be 1:1 as in this case, but, for example, in the ratio of 1:4.

What is claimed is:

1. In an arrangement for separating or singling out paper sheets, documents, and similar recording media from a batch, with several of the sheets of documents initially being moved toward a separating slot with the aid of an intermittent pull-off device and a vibrating device, after which the leading recording medium is extracted from the batch, with the aid of a further pull-off device and an intermittently acting device serving to hold back the trailing recording media, and fed to a transporting arrangement through the separating slot, the improvement comprising, in combination, a first rotating suction drum mounted at the rear end of the batch, considered in the direction of separation movement, and rotating in a direction to feed the leading recording media toward said separating slot to constitute said intermittent pull-off device, said first suction drum being formed with circumferentially spaced suction channels, a rotary slide valve operatively associated with said first suction drum and operable to connect said suction channels intermittently to a suction system; a vibrating table supporting the batch; a vibrator operable to vibrate said table; said table and vibrator constituting said vibrating device; a second rotating suction drum, formed with suction channels, arranged within the range of said separating slot and serving as a separating drum; a rotating hold-back suction drum also arranged within the range of said separating slot and rotating in a direction opposite the direction of rotation of said first suction drum to serve as said hold-back device; said hold-back suction drum being formed with circumferentially spaced suction channels; and a second rotary slide valve operatively associated with said hold-back suction drum and operable to connect the suction channels thereof intermittently to a suction system.

2. An arrangement according to claim 1, in which both said first rotating suction drum and said hold-back suction drum are coated with a material having a high coefficient of friction with respect to the material of the recording media.

3. An arrangement according to claim 1, in which the separating drum comprises only one row of suction channels arranged in an axial plane thereof; a third rotary slide valve operatively associated with said separating drum; said third rotary slide valve having a suction opening communicable with the suction channels of said separating drum and having a circumferential extent substantially greater than that of the openings of the suction channels of said separating drum; and suction channels in said third rotary slide valve operable to connect the suction opening thereof to the suction system.

4. An arrangement according to claim 1, in which said separating drum is formed with air vent means circumferentially adjacent the suction channels thereof.

5. An arrangement according to claim 4, in which there is provided one single air vent slot extending in the direction of the axis of rotation of the separating drum.

6. An arrangement according to claim 4, in which said air vent means comprises slots in the periphery of said separating drum.

7. An arrangement according to claim 4, in which several air vent slots extending throughout a part of the circumference of the separating drum, extend forwardly, from a point adjacent each suction channel of the separating drum, in the direction of rotation of the suction drum.

8. An arrangement according to claim 1, including a hold-back rake, having spaced substantially parallel rods, mounted on the upstream side of said hold-back drum considered in the direction of movement of the recording medium toward said separating slot.

9. An arrangement according to claim 8, in which the hold-back rake is disposed upstream of the hold-back drum at a distance almost corresponding to half the diameter thereof.

10. An arrangement according to claim 8 in which the individual rods of the hold-back rake are made from a solid round material.

11. An arrangement according to claim 10, in which the rods of said hold-back rake are bent, intermediate their ends, to form diagonally extending bent portions interconnecting mutually perpendicular portions, the rods being flattened in said bent portions.

12. An arrangement according to claim 8, including a second hold-back rake, having spaced parallel rods, disposed upstream of said first suction drum, considering the direction of movement of the recording media, and firmly connected to said vibrating table.

13. An arrangement according to claim 12, in which the individual rods of the second hold-back rake are made from a solid material.

14. An arrangement according to claim 8, including a support plate engaging that surface of the stack adjacent said first suction roller and said separating roller; and a pressure plate engaging the opposite surface of said stack; said pressure plate being formed as a grate constituted by spaced parallel rods, and the rods in said grate extending between the rods of said rake.

15. An arrangement according to claim 1, including a support plate engaging that surface of the stack of recording media adjacent said first suction drum and said separating drum; and a reflection light barrier positioned adjacent the side of said support plate opposite to the side thereof engaged by the stack of recording medium; said support plate having an aperture therethrough aligned with said reflection light barrier whereby the presence or absence of documents on said vibrating table may be checked.

* * * * *